US009859648B2

(12) United States Patent
Hara et al.

(10) Patent No.: US 9,859,648 B2
(45) Date of Patent: Jan. 2, 2018

(54) WATERPROOF CONNECTOR

(71) Applicant: Sumitomo Wiring Systems, Ltd., Yokkaichi, Mie (JP)

(72) Inventors: Teruo Hara, Mie (JP); Yuichi Nakanishi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/303,382

(22) PCT Filed: Apr. 6, 2015

(86) PCT No.: PCT/JP2015/060716
§ 371 (c)(1),
(2) Date: Oct. 11, 2016

(87) PCT Pub. No.: WO2015/163125
PCT Pub. Date: Oct. 29, 2015

(65) Prior Publication Data

US 2017/0033492 A1 Feb. 2, 2017

(30) Foreign Application Priority Data

Apr. 25, 2014 (JP) ..... 2014-091791

(51) Int. Cl.
*H01R 13/52* (2006.01)
*H01R 4/18* (2006.01)
(Continued)

(52) U.S. Cl.
CPC ..... *H01R 13/5208* (2013.01); *H01R 4/18* (2013.01); *H01R 13/11* (2013.01); *H01R 13/4367* (2013.01); *H01R 13/506* (2013.01)

(58) Field of Classification Search
CPC ..... H01R 13/5208; H01R 13/5205; H01R 13/506; H01R 13/7032; H01R 13/6633; H01R 13/11; H01R 13/4367; H01R 4/18
(Continued)

(56) References Cited

U.S. PATENT DOCUMENTS 5,788,520 A 8/1998 Roche
2002/0115345 A1 8/2002 Nakamura et al.
(Continued)

FOREIGN PATENT DOCUMENTS

JP 11354196 12/1999
JP 2001-110507 4/2001
(Continued)

OTHER PUBLICATIONS

International Search Report dated Jun. 30, 2015.

*Primary Examiner* — Jean F Duverne
(74) *Attorney, Agent, or Firm* — Gerald E. Hespos; Michael J. Porco; Matthew T. Hespos

(57) ABSTRACT

A waterproof connector (10) includes a female housing (30) formed with cavities (31), and female terminals (20) connected to ends of wires (W) are inserted into the cavities (31) from behind. Shorting terminals (50) are accommodated in terminal accommodating portions (40) in a front part of the housing (30) to short adjacent female terminals (20). A one-piece rubber plug (60) is fit into a rear part of the housing (30) and includes through holes (62) through which the wires (W) are to be inserted. A rear holder (70) is mounted into the housing (30) to retain the one-piece rubber plug (60). Recesses (65) are provided on the one-piece rubber plug (60) in areas behind the terminal accommodating portions (40). Compressing protrusions (75) project from the rear holder (70) and are press-fit into the recesses (65) from behind.

5 Claims, 16 Drawing Sheets

(51) Int. Cl.
*H01R 13/11* (2006.01)
*H01R 13/436* (2006.01)
*H01R 13/506* (2006.01)

(58) Field of Classification Search
USPC ..... 439/275
See application file for complete search history.

(56) References Cited

U.S. PATENT DOCUMENTS

| | | | | |
|---|---|---|---|---|
| 2006/0086900 | A1* | 4/2006 | Nakamura | H01R 13/6633 250/239 |
| 2008/0233778 | A1* | 9/2008 | Moll | H01R 13/7032 439/188 |
| 2008/0233784 | A1* | 9/2008 | Patterson | H01R 13/5205 439/278 |
| 2015/0140847 | A1 | 5/2015 | Kanemura | |

FOREIGN PATENT DOCUMENTS

| | | |
|---|---|---|
| JP | 2001-196129 | 7/2001 |
| JP | 2002-252056 | 9/2002 |
| JP | 2015-99684 | 5/2015 |

* cited by examiner

WATERPROOF CONNECTOR

BACKGROUND

1. Field of the Invention

The invention relates to a waterproof connector.

2. Description of the Related Art

Japanese Unexamined Patent Publication No. 2002-252056 discloses a waterproof connector including a waterproof packing formed with a plurality of wire insertion holes. The waterproof packing is fit into a rear part of a housing from behind and retained by a rear holder mounted on a rear end part of the housing. The rear holder is movable in a front-back direction between a partial locking position and a full locking position. The rear holder is provided with an annular portion surrounding the outer periphery of the waterproof packing. When the rear holder is moved from the partial locking position to the full locking position, the annular portion compresses the waterproof packing inwardly from an outer side, thereby enhancing a close contact force between the wires and the waterproof packing.

According to the waterproof connector of Japanese Unexamined Patent Publication No. 2002-252056, the annular portion of the rear holder is larger in size than the waterproof packing and the waterproof connector is enlarged since the waterproof packing is compressed from the outer side. Further, if wire insertion holes are formed in plural stages and arranged in vertical and lateral directions, the insertion holes arranged in a central part cannot be compressed merely by compressing the waterproof packing from the outer side and the sealability of the waterproof packing for the wires arranged in the central part is reduced.

In this specification, a technique for enhancing sealability for each wire while preventing the enlargement of a waterproof connector is disclosed.

SUMMARY

This specification is directed to a waterproof connector with terminal fittings to be connected to ends of wires. The connector has a housing formed with a plurality of cavities arranged side by side and configured such that the wires are accommodated therein from behind together with the terminal fittings. Terminal accommodating portions are provided along a row of the plurality of terminal fittings in a front end part of the housing and are configured to accommodate shorting terminals for shorting the plurality of terminal fittings. A seal is to be fit into the housing from behind and includes through holes provided side by side to correspond to the cavities and configured such that the wires are inserted therethroughA rear holder is mounted behind the seal in the housing and is configured to retain the seal. Recesses are provided along a row of the through holes on the seal and are arranged behind laterally long terminal accommodation areas in the housing where the terminal accommodating portions are formed. Compressing protrusions project from the rear holder and are configured to press the seal in directions to reduce the through holes in diameter by being press-fit into the recesses from behind.

According to this configuration, by providing the recesses and the compressing protrusions behind the laterally long terminal accommodation areas where the terminal accommodating portions are formed, it is possible to press the seal in the directions to reduce the through holes in diameter at positions along the through holes while effectively utilizing dead spaces formed behind the terminal accommodating portions. In this way, it is possible to enhance sealability between each wire and the seal while preventing the enlargement of the rear holder, and consequently, of the waterproof connector.

The recesses may be formed over a range of the plurality of through holes. According to this configuration, a plurality of through holes can be reduced in diameter collectively by one compressing protrusion. Thus, the structures of the seal and the rear holder can be simplified and the production cost of the waterproof connector can be reduced.

The cavities may be formed in a plurality of stages in a height direction perpendicular to an arrangement direction, and the recesses may be formed between the through holes adjacent in the height direction. According to this configuration, both through holes adjacent in the height direction can be compressed by one compressing protrusion.

According to the technique disclosed by this specification, it is possible to enhance sealability for each wire while preventing the enlargement of a waterproof connector.

DETAILED DESCRIPTION

A first embodiment is described with reference to FIGS. 1 to 12.

Figure 8:
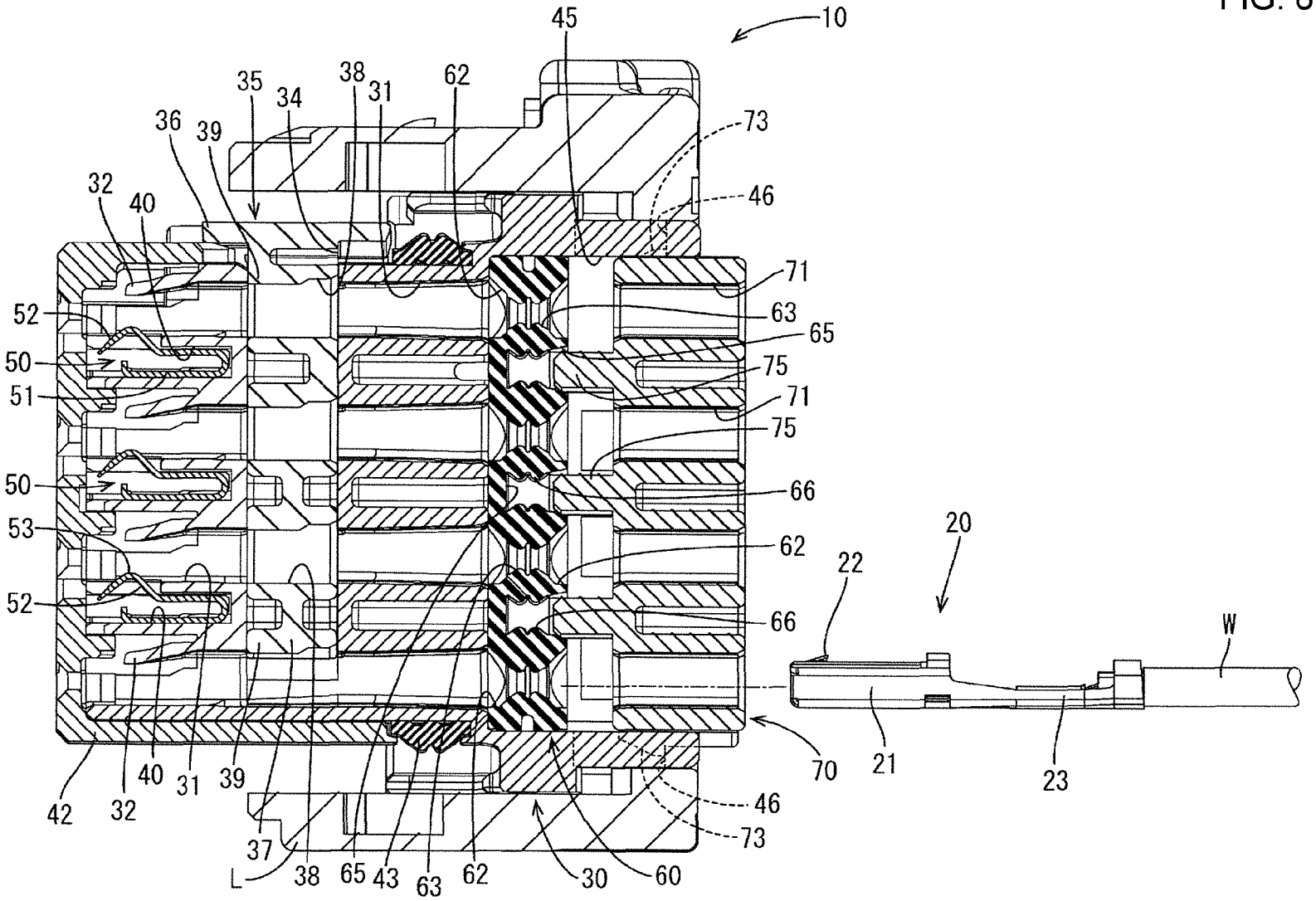
FIG. 8 is a longitudinal section, corresponding to a cross-section of FIG. 4, showing a state before a female terminal and a wire are inserted into a female housing.
Figure 10:
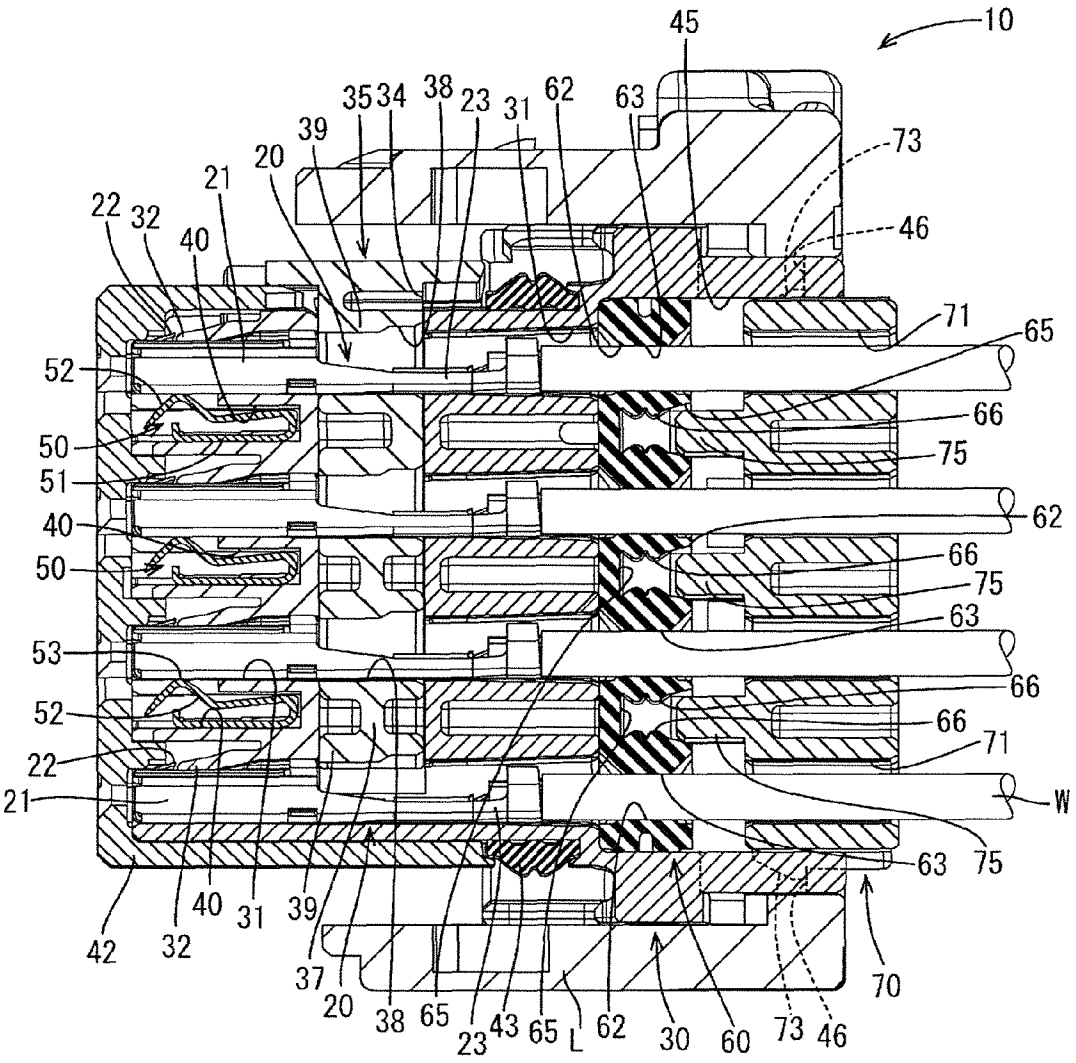
FIG. 10 is a longitudinal section, corresponding to the cross-section of FIG. 4, showing a state where female terminals and wires are inserted in the female housing and the rear holder is arranged at a partial locking position.
Figure 11:
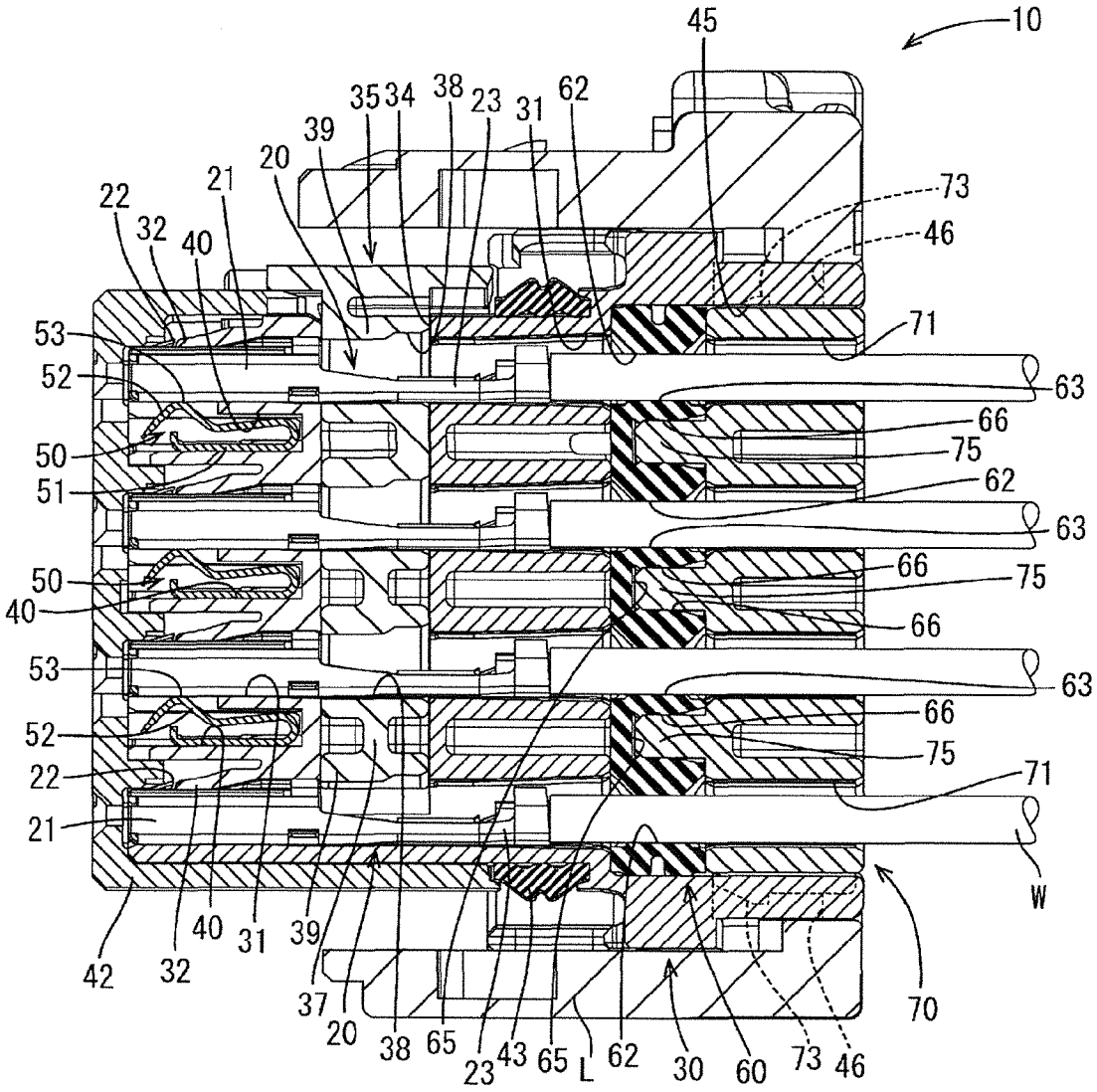
FIG. 11 is a longitudinal section, corresponding to the cross-section of FIG. 4, showing a state where the female terminals and the wires are inserted in the female housing and the rear holder is arranged at a full locking position.
Figure 12:
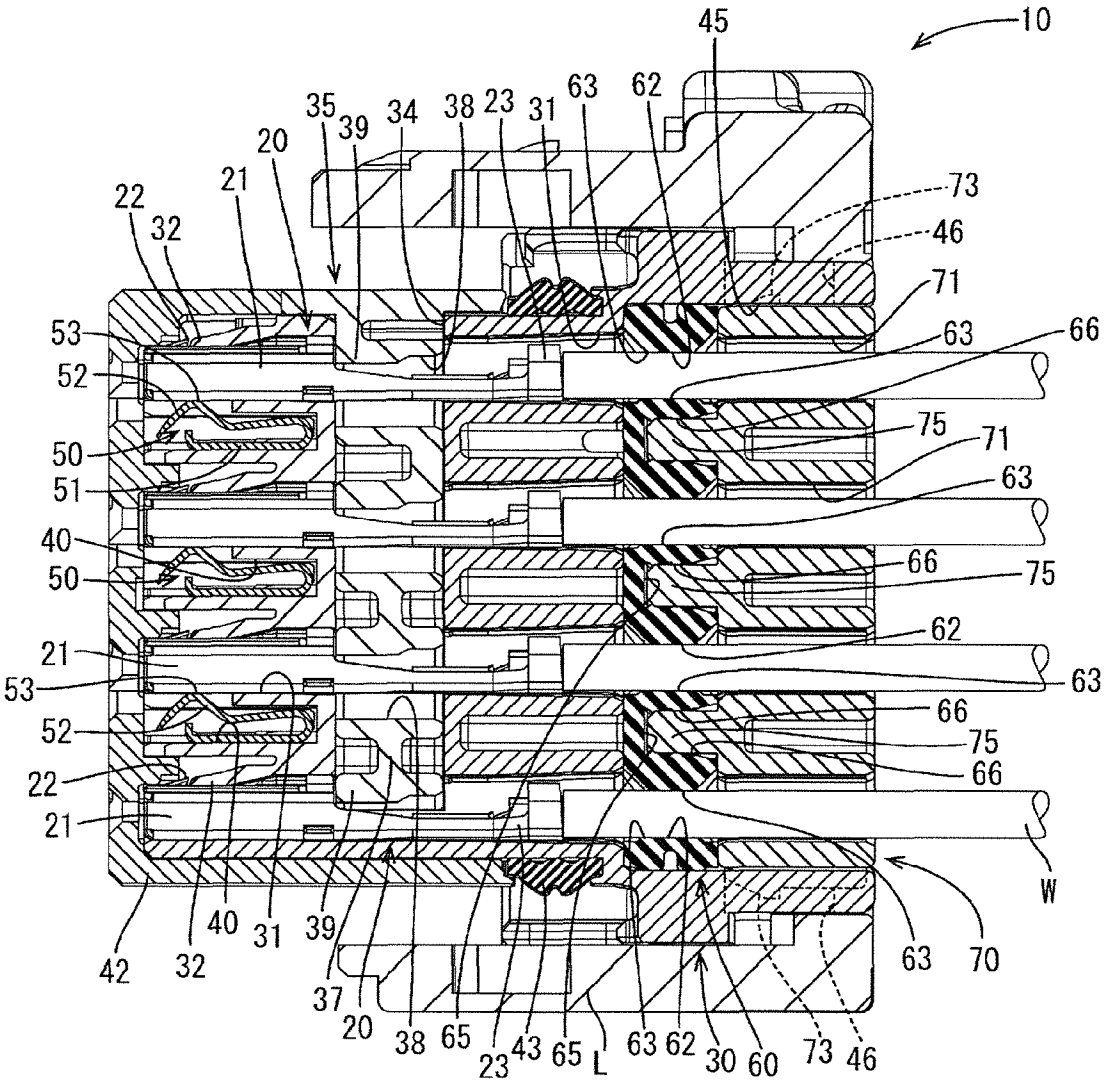
FIG. 12 is a longitudinal section, corresponding to the cross-section of FIG. 4, showing a state where a retainer is displaced to a full locking state.

A waterproof connector 10 including a lever L for assisting the connection and separation to and from an unillustrated mating connector by being rotated is illustrated in this embodiment. As shown in FIGS. 10 to 12, the waterproof connector 10 includes female terminals (an example of "terminal fittings") 20 to be connected to ends of wires W, a female housing (an example of a "housing") 30 made of synthetic resin and formed with a plurality of cavities 31 arranged such that the female terminals 20 and the wires W are accommodated thereinto from behind, shorting terminals 50 for shorting a plurality of female terminals 20, a one-piece rubber plug (an example of a "seal") 60 to be fitted into a rear part of the female housing 30 and a rear holder 70 made of synthetic resin and configured to prevent the one-piece rubber plug 60 from coming out backward by being mounted into a rear end part of the female housing 30. Note that, in the following description, a vertical direction corresponds to a height direction and is based on FIG. 2. Further, left and right sides of FIG. 8 are referred to as front and rear sides concerning a front-back direction.

The female terminal 20 is formed by press-working a metal plate material excellent in electrical conductivity. As shown in FIG. 8, the female terminal 20 is formed such that a wire connecting portion 23 is provided behind a terminal connecting portion 21 in the form of a rectangular tube, and the female terminal 20 is connected to the end of the wire W by crimping the wire connecting portion 23 to the end of the wire W.

An unillustrated male terminal provided in the mating connector is inserted into the terminal connecting portion 21 from behind so that the terminal connecting portion 21 and the male terminal are electrically connected.

Figure 7:
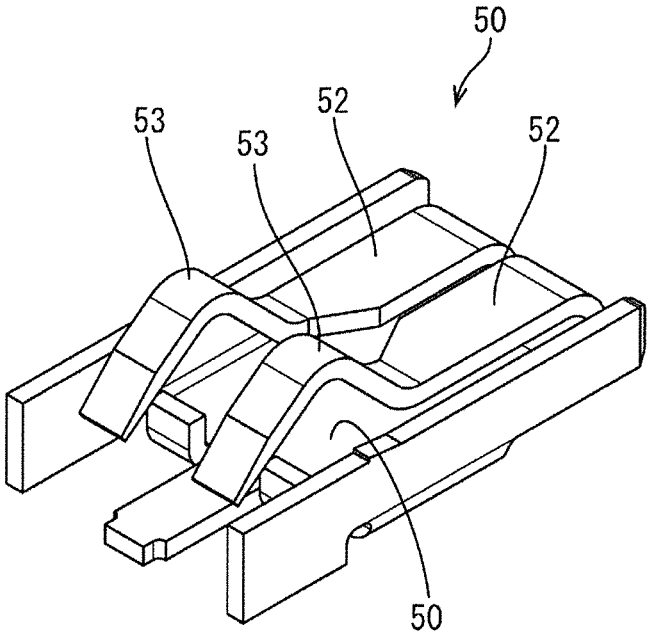
FIG. 7 is a perspective view of a shorting terminal.

The shorting terminal 50 is formed by press-working a metal plate material excellent in electrical conductivity. As shown in FIG. 7, the shorting terminal 50 includes a pair of resilient pieces 52 forked in a width direction at the rear edge of a bottom plate 51 and folded forward, and each resilient piece 52 is vertically resiliently displaceable with a folded part as a supporting point.

A front end part of the resilient piece 52 is formed into a chevron shape projecting upwardly, and a top part serves as a contact portion 53 to be brought into contact with the lower surface of the terminal connecting portion 21 in the female terminal 20.

As shown in FIGS. 1 to 4, the female housing 30 is in the form of a substantially rectangular block and the cavities 31 for accommodating the female terminals 20 and the wires W are formed to penetrate in the front-back direction in the female housing 30.

Figure 1:
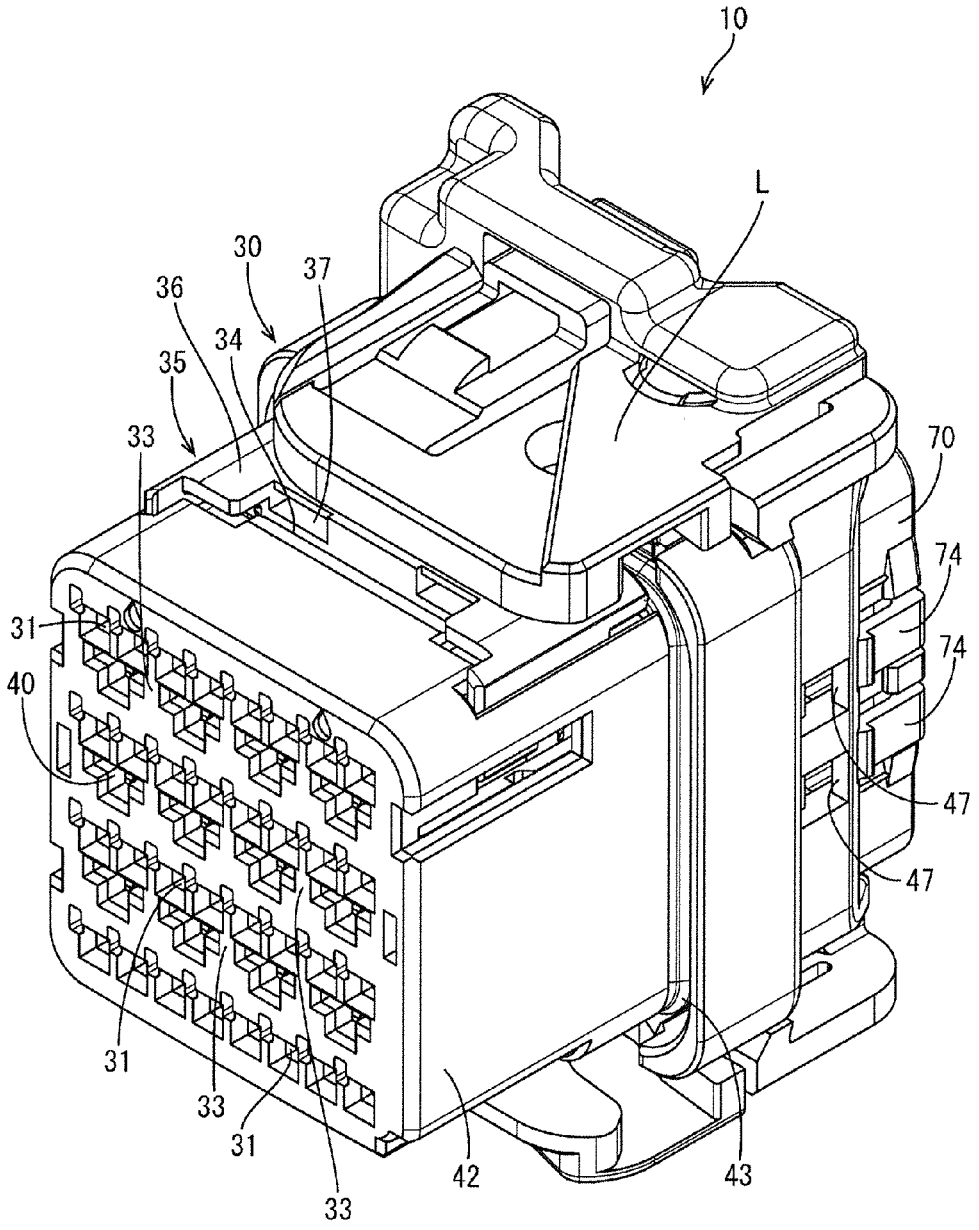
FIG. 1 is a perspective view of a waterproof connector according to a first embodiment.
Figure 2:
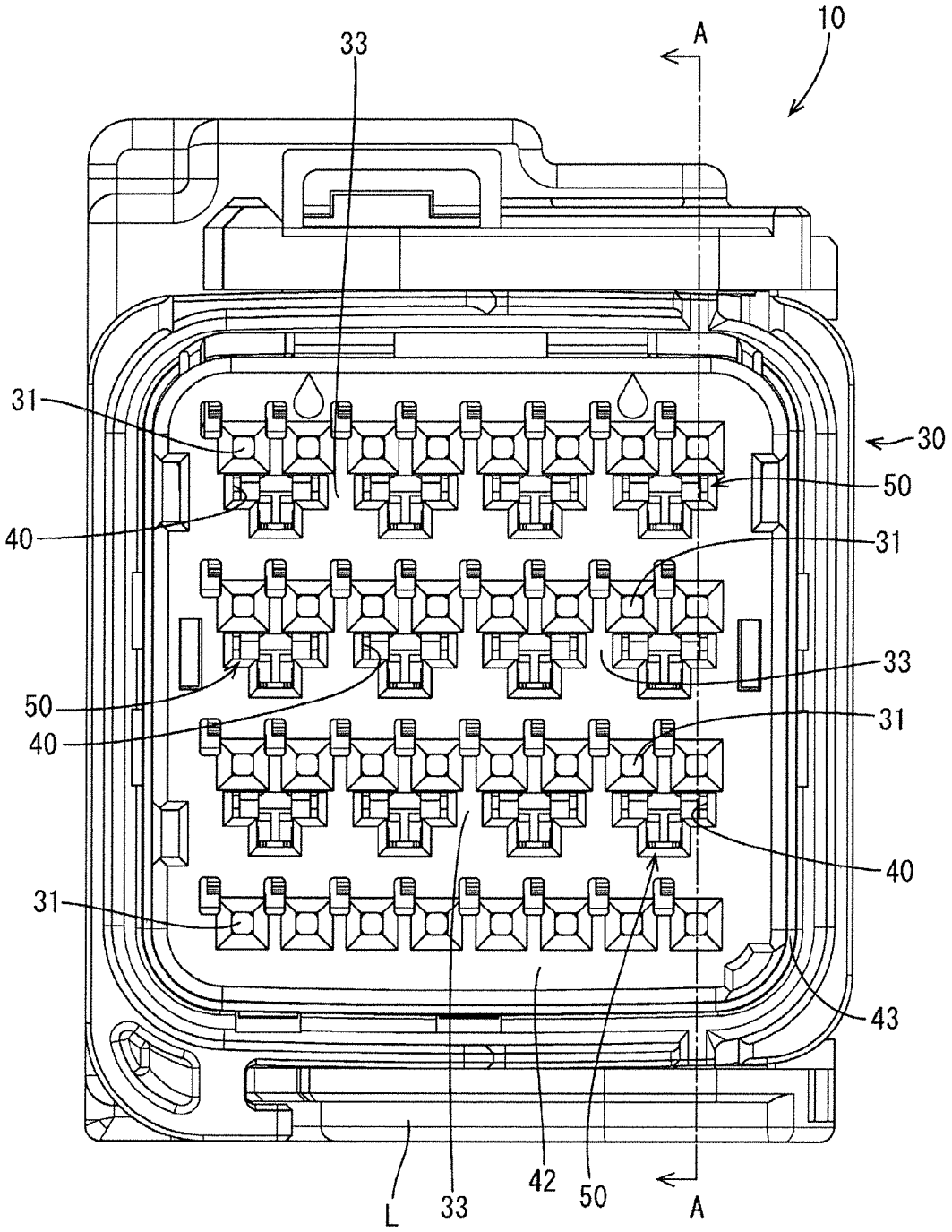
FIG. 2 is a front view of the waterproof connector.
Figure 3:
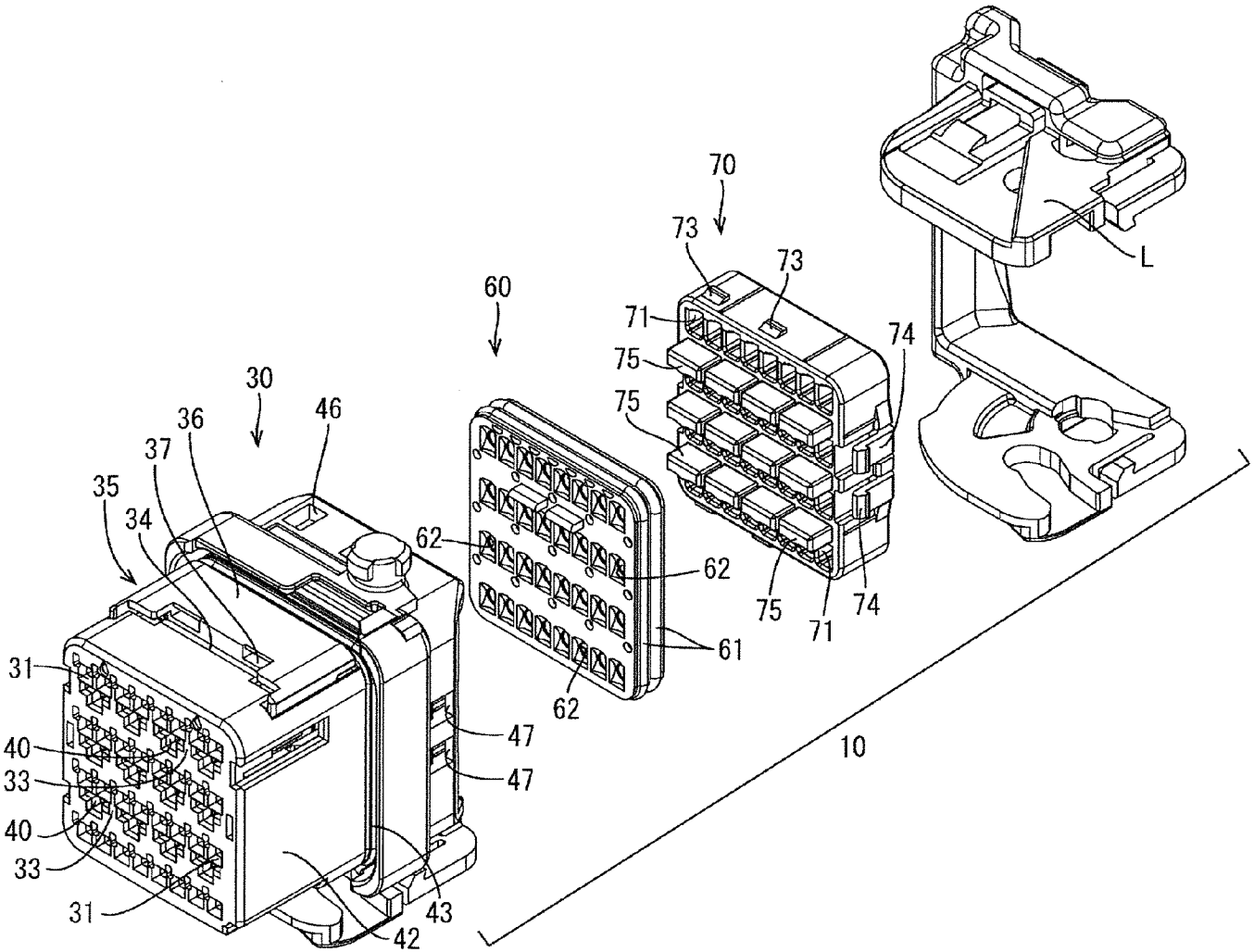
FIG. 3 is a partial exploded perspective view of the waterproof connector.
Figure 4:
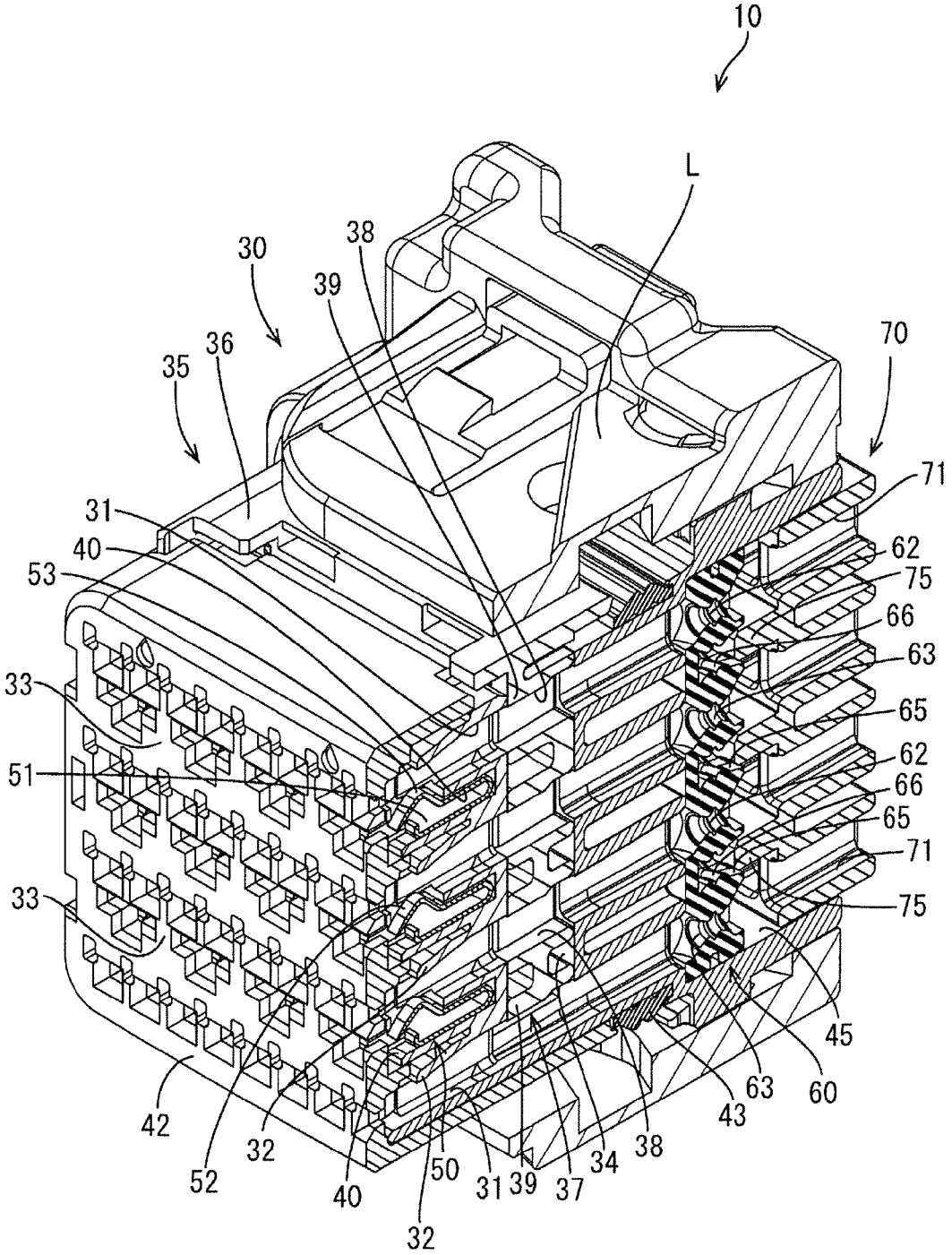
FIG. 4 is a perspective view in section along A-A of FIG. 2.

As shown in FIG. 2, the cavities 31 are arranged in a plurality of (four in this embodiment) stages in the vertical direction with a plurality of (eight in this embodiment) cavities 31 juxtaposed in the width direction in each stage.

As shown in FIGS. 4 and 8 to 12, a locking lance 32 for locking the terminal connecting portion 21 of the female terminal 20 from behind is formed in a front end part of each cavity 31. This locking lance 32 is cantilevered forward from the upper surface of the cavity 31. When the female terminal 20 reaches a proper position in the cavity 31, the locking lance 32 locks a locking portion 22 provided on the upper surface of the terminal connecting portion 21 from behind, whereby the female terminal 20 is retained in the cavity 31.

A retainer mounting hole 34 into which a retainer 35 is to be mounted is formed to be open upward behind the locking lances 32 of the female housing 30, and communicates with each cavity 31.

The retainer 35 is formed such that a plate-like retainer main body 37 extends downward from a lid portion 36 for closing an upper end opening of the retainer mounting hole 34, and the retainer main body 37 is formed with through holes 38 corresponding to the respective cavities 31 and penetrating in the front-back direction. A retaining portion 39 to be locked to a rear end part of the terminal connecting portion 21 in the female terminal 20 is formed on the upper surface of each through hole 38. When the retainer 35 is displaced from a partial locking state shown in FIG. 11 to a full locking state (see FIG. 12) where the retainer main body 37 is completely inserted into the retainer mounting hole 34, the terminal connecting portions 21 are locked from behind by the retaining portions 39 and the female terminal 20 are doubly locked.

Terminal accommodating portions 40 into which the shorting terminals 50 are to be accommodated from front are provided in a front end part of the female housing 30. As shown in FIG. 8, the terminal accommodating portions 40 are provided in terminal accommodation areas 33 long in the width direction and formed between the cavities 31 adjacent in the vertical direction, and one terminal accommodating portion 40 is formed for two cavities 31 arranged side by side. Further, each terminal accommodating portion 40 vertically communicates with two cavities 31 arranged above. When the female terminals 20 are accommodated into the cavities 31 with the shorting terminal 50 accommodated in the terminal accommodating portion 40, the shorting terminal 50 contacts the terminal connecting portions 21 of the female terminals 20 accommodated into the two cavities 31 above to short the adjacent two female terminals 20.

Further, a hood-like front holder 42 for covering a front part of the female housing 30 from the front is mounted on the front part of the female housing 30 as shown in FIGS. 4 and 8 to 12. When the front holder 42 is mounted on the female housing 30, a seal ring 43 externally fit on a substantially central part of the female housing 30 in the front-back direction is retained by a rear end part of the front holder 42 and the shorting terminals 50 are retained by the front wall of the front holder 42.

An accommodation recess 45 open backward is formed in a rear part of the female housing 30 by recessing the rear surface of the female housing 30 forward. As shown in FIGS. 3, 4 and 8 to 12, the one-piece rubber plug 60 and the rear holder 70 are fittable into this accommodation recess 45 from behind.

Figure 5:
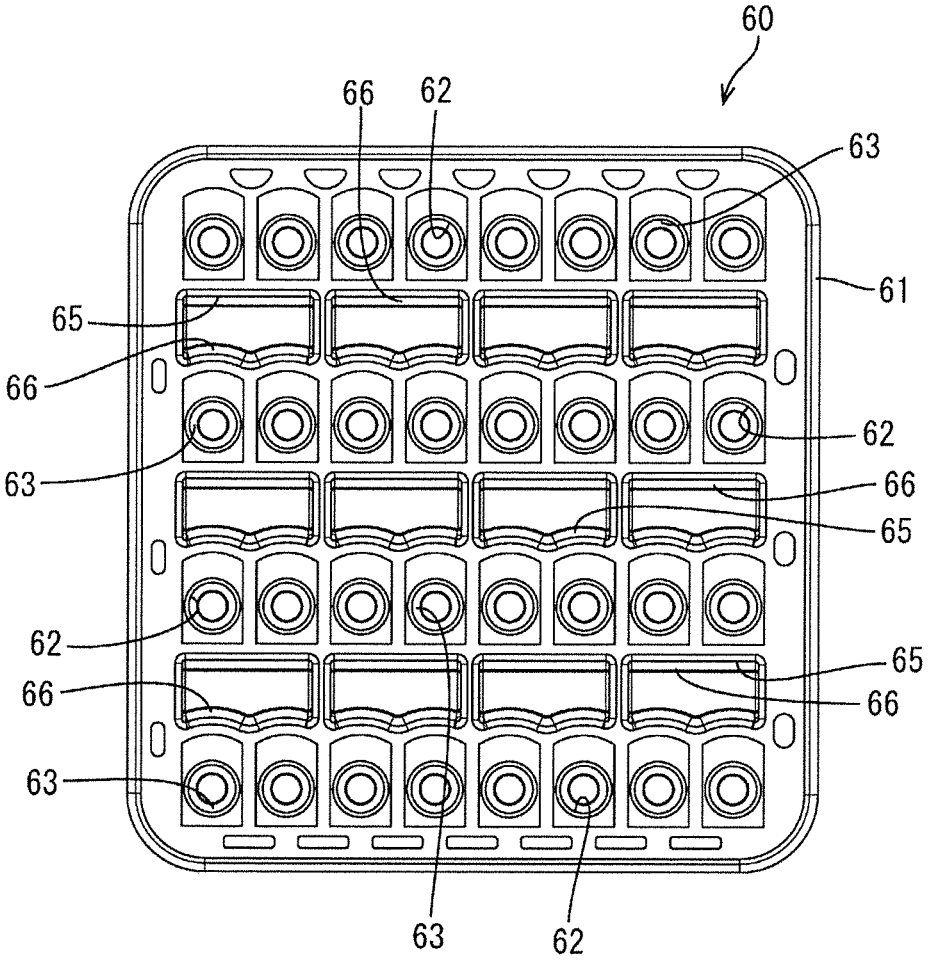
FIG. 5 is a rear view of a one-piece rubber plug.
Figure 6:
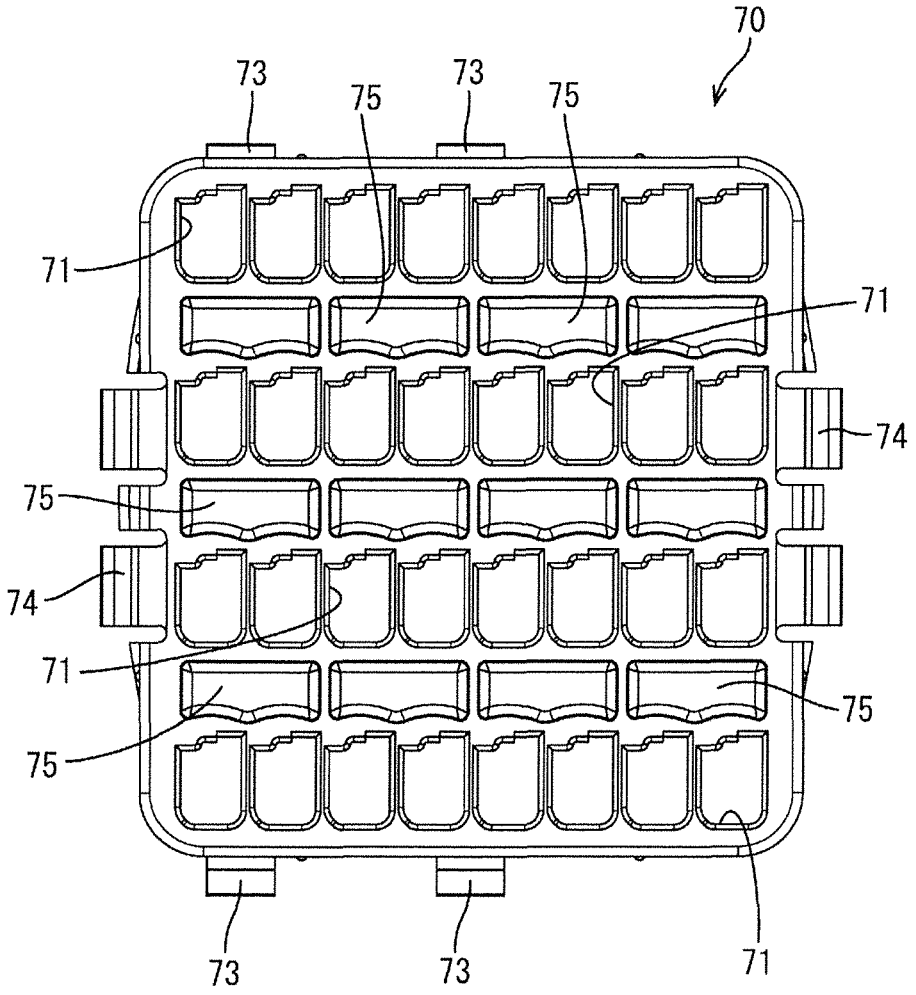
FIG. 6 is a front view of a rear holder.

The one-piece rubber plug 60 is made of oil-containing silicon or the like and formed to be substantially rectangular in a rear view as shown in FIG. 5. The one-piece rubber plug 60 is in the form of a plate thick in the front-back direction and two outer peripheral lips 61 for sealing between the one-piece rubber plug 60 and the inner peripheral surface of the accommodation recess 45 by being resiliently held in close contact with the inner peripheral surface of the accommodation recess 45 are formed side by side in the front-back direction on the outer periphery of the one-piece rubber plug 60.

Further, the one-piece rubber plug 60 is formed with a plurality of through holes 62 penetrating in the front-back direction, and the wires W are individually inserted through the through holes 62. The through holes 62 are formed to correspond to the respective cavities 31, and vertical dimensions of front and rear openings of each through hole 62 are set to be larger than that of the terminal connecting portion 21 of the female terminal 20. Further, two inner peripheral lips 63 to be held resiliently in close contact with the outer peripheral surface of the wire W are provided circumferentially side by side in the front-back direction substantially in a central part of the inner peripheral surface of each through hole 62 in the front-back direction. These inner peripheral lips 63 are thick lips projecting more toward an axial center of the through hole 62 as they come closer. The inner peripheral lips 63 are held in close contact with the outer peripheral surface of the wire W, thereby sealing between the one-piece rubber plug 60 and the wire W.

The rear holder 70 is in the form of a plate substantially rectangular in a front view and thick in the front-back direction and sized to be matched with and fitted into the accommodation recess 45. The rear holder 70 is formed with a plurality of insertion holes 71 penetrating in the front-back direction, and the wires W pulled out backward from the through holes 62 of the one-piece rubber plug 60 are inserted individually through the insertion holes 71. The insertion holes 71 are formed to correspond to the through holes 62 of the one-piece rubber plug 60 and each insertion hole 71 has substantially the same size as the rear end opening of the cavity 31 open in the accommodation recess 45.

Two locking protrusions 73 are formed on each of upper and lower surfaces of the outer peripheral surface of the rear holder 70 and two resilient locking pieces 74 are formed on each of opposite side surfaces of the outer peripheral surface of the rear holder 70.

The respective locking protrusions 73 are fittable into pairs of partial locking holes 46 formed on the upper and lower surfaces of the female housing 30. The respective locking protrusions 73 are fit into the corresponding partial locking holes 46 so that the rear holder 70 is held at a partial locking position shown in FIGS. 8 to 10.

The respective resilient locking pieces 74 are formed to be resiliently displaceable inwardly and fittable into pairs of full locking holes 47 formed on opposite widthwise sides of the female housing 30. The respective resilient locking pieces 74 are fit into the corresponding full locking holes 47 so that the rear holder 70 is held at a full locking position shown in FIGS. 11 and 12. Further, when the rear holder 70 is held at the full locking position, the front surface thereof is held in surface contact with the rear surface of the one-piece rubber plug 60 and the one-piece rubber plug 60 is positioned and retained in the accommodation recess 45.

Forwardly recessed bottomed recesses 65 (four in this embodiment) are formed in each stage on the rear surface of the one-piece rubber plug 60, and a plurality of (four in this embodiment) compressing protrusions 75 to be press-fit into the recesses 65 of the one-piece rubber plug 60 from behind are provided in each stage on the front surface of the rear holder 70.

Four recesses 65 are formed side by side over the entire width of an area where the through holes 62 are arranged while extending along a row of the plurality of through holes 62 arranged side by side in the width direction and arranged between vertically adjacent through holes 62. Further, the recess 65 has a substantially rectangular shape long in the width direction and having a width corresponding to two through holes 62, and the lower surface of the recess 65 is raised arcuately between opposite widthwise end parts and a substantially widthwise central part to extend along the upper edges of the through holes 62 arranged below. That is, each recess 65 is formed at least either above or below the through holes 62 in a space behind the terminal accommodation area 33 where the terminal accommodating portion 40 for accommodating the shorting terminal 60 is provided.

Two compressive lips 66 to be pressed by the compressing protrusion 75 of the rear holder 70 are provided to project on each of the upper and lower surfaces in a back part of the recess 65 while extending over the entire width and being arranged side by side in the front-back direction. These compressive lips 66 are thick lips projecting more inwardly as they come closer, and are arranged substantially at the same positions as the inner peripheral lips 63 of the through holes 62 in the front-back direction.

On the other hand, each compressing protrusion 75 is in the form of a substantially rectangular plate long in the width direction and having a width corresponding to two insertion holes 71. Similar to the recesses 65 of the one-piece rubber plug 60, four compressing protrusions 75 are arranged side by side in the width direction. The compressing protrusion 75 projects forward from the front surface of the rear holder 70 and a projecting distance thereof is set substantially equal to a depth of the recess 65. Further, the lower surface of each compressing protrusion 75 is recessed arcuately between opposite widthwise end parts and a substantially widthwise central part.

Further, each compressing protrusion 75 is provided at a position corresponding to the recess 65 of the one-piece rubber plug 60 between vertically adjacent insertion holes 71 and has a slightly larger outer peripheral shape that an inner peripheral shape of the recess 65.

Thus, the compressing protrusions 75 vertically press the compressive lips 66 in the recesses 65 and enter the recesses 65 while vertically pushing and widening the recesses 65 in the process of displacing the rear holder 70 from the partial locking position to the full locking position. When the compressing protrusions 75 are inserted completely into the recesses 65, the inner peripheral lips 63 of the through holes 62 arranged above and below the recesses 65 are pressed in directions to reduce each through hole 62 in diameter as shown in FIG. 11.

That is, when the compressing protrusions 75 are press-fit into the recesses 65, the inner peripheral lips 63 are pressed vertically in directions to reduce the through holes 62 in diameter via the compressive lips 66 and the inner peripheral lips 63 are strongly held in close contact with the wires W, thereby enhancing sealability between the wires W and the one-piece rubber plug 60.

This embodiment is configured as described above. Next, an example of a procedure of assembling the waterproof connector 10 by mounting the female terminals 20 connected to the ends of the wires W into the female housing 30 is described briefly and functions and effects of the waterproof connector 10 are described.

First, as shown in FIG. 8, the female terminal 20 connected to the end of the wire W is arranged behind the female housing 30 and inserted into the cavity 31 from behind.

Figure 9:
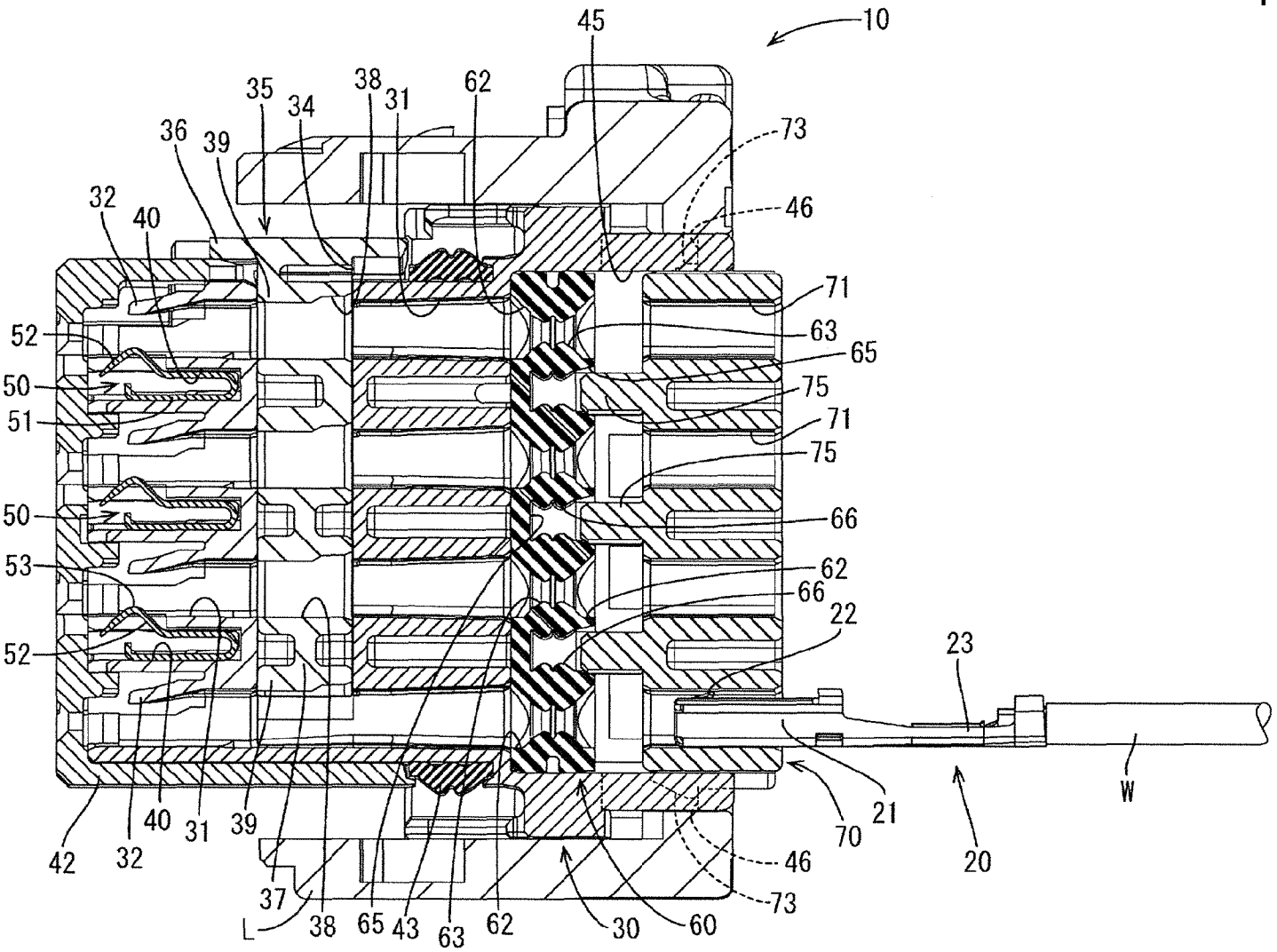
FIG. 9 is a longitudinal section, corresponding to the cross-section of FIG. 4, showing a state in the process of inserting the female terminal and the wire into the female housing.

Here, as shown in FIG. 9, the female terminal 20 is inserted into the insertion hole 71 of the rear holder 70 from behind and the terminal connecting portion 21 is smoothly inserted forward in the insertion hole 71.

After passing the insertion hole 71, the tip of the terminal connecting portion 21 enters the through hole 62 of the one-piece rubber plug 60. Here, the rear end opening of the through hole 62 is vertically larger than the terminal connecting portion 21 and the through hole 62 is in a state before being reduced in diameter. Thus, the terminal connecting portion 21 smoothly moves over the inner peripheral lips 63 and enters the through hole 62.

When the terminal connecting portion 21 reaches a proper position in the cavity 31, the lower surface of the terminal connecting portion 21 comes into contact with the contact portion 53 of the resilient piece 52 in the shorting terminal 50 arranged below and the locking portion 22 of the terminal connecting portion 21 is locked from behind by the locking lance 32, thereby preventing the female terminal 20 from come out backward. Further, at this time, the inner peripheral lips 63 of the one-piece rubber plug 60 are resiliently held in close contact with the outer peripheral surface of the wire W and the outer peripheral lips 61 are held resiliently in close contact with the inner peripheral surface of the accommodation recess 45.

Then, when the inserting operations of all the female terminals 20 are completed as shown in FIG. 10, two adjacent female terminals 20 are shorted.

Subsequently, the rear holder 70 held at the partial locking position is displaced to the full locking position by being further pushed into the accommodation recess 45 (see FIG. 11). Here, when the rear holder 70 is pressed forward, the compressing protrusions 75 of the rear holder 70 enter the recesses 65 of the one-piece rubber plug 60 to vertically press the compressive lips 66. Then, the inner peripheral lips 63 of the through holes 62 arranged above and below the recesses 65 are pressed to vertically reduce the through holes 62 in diameter. In this way, the inner peripheral lips 63 are held strongly in close contact with the wires W and the outer peripheral lips 61 are held strongly in close contact with the inner peripheral surface of the accommodation recess 45, thereby ensuring high sealability between the wires W and the female housing 30.

Finally, the retainer 35 in the partial locking state is inserted into the retainer mounting hole 34 and set in the full locking state shown in FIG. 12, and the terminal connecting portions 21 are locked from behind by the retaining portions 39 of the retainer main body 37. In this way, the female terminals 20 are doubly locked by the locking lances 32 and the retainer 35 and the waterproof connector 10 is completed.

As described above, according to this embodiment, the one-piece rubber plug 60 is formed with the recesses 65, effectively utilizing dead spaces formed behind the terminal accommodation areas 33 where the terminal accommodating portions 40 for accommodating the shorting terminals 50 are provided, and the inner peripheral lips 63 can be pressed in directions to reduce the through holes 62 in diameter by press-fitting the compressing protrusions 75 of the rear holder 70 into these recesses 65.

That is, since a rubber plug such as a waterproof packing need not to be compressed from an outer side unlike before, the rear holder 70 can be prevented from becoming larger in size than the one-piece rubber plug 60.

Further, since the recesses 65 of the one-piece rubber plug 60 provided in the dead spaces are formed at least either above or below all the through holes 62, the inner peripheral lips 63 can be pressed in directions to reduce all the through holes 62 in diameter by the compressing protrusions 75 of the rear holder 70. In this way, sealability between each wire W and the one-piece rubber plug 60 can be enhanced.

Further, according to this embodiment, one recess 65 of the one-piece rubber plug 60 and one compressing protrusion 75 of the rear holder 70 are formed for two through holes 62 and two insertion hole 71 arranged side by side in the width direction and formed between vertically adjacent through holes 62 and insertion holes 71. Thus, the structures of the one-piece rubber plug 60 and the rear holder 70 can be simplified, for example, as compared to the case where one recess and one compressing protrusion are formed for one through hole. In this way, the production cost of the one-piece rubber plug 60 and the rear holder 70 and, consequently, that of the waterproof connector 10 can be reduced.

Next, a second embodiment is described with reference to FIGS. 13 to 16.

A waterproof connector 110 of the second embodiment differs from the first embodiment in the number of the cavities 31 of the female housing 30, the number of the through holes 62 of the one-piece rubber plug 60, the width of the recesses 65, the number of insertion holes 71 of the rear holder 70 and the width of the compressing protrusions 75. Configurations, functions and effects common to the first embodiment are not described to avoid repeated description. Further, the same components as in the first embodiment are denoted by the same reference signs.

Figure 13:
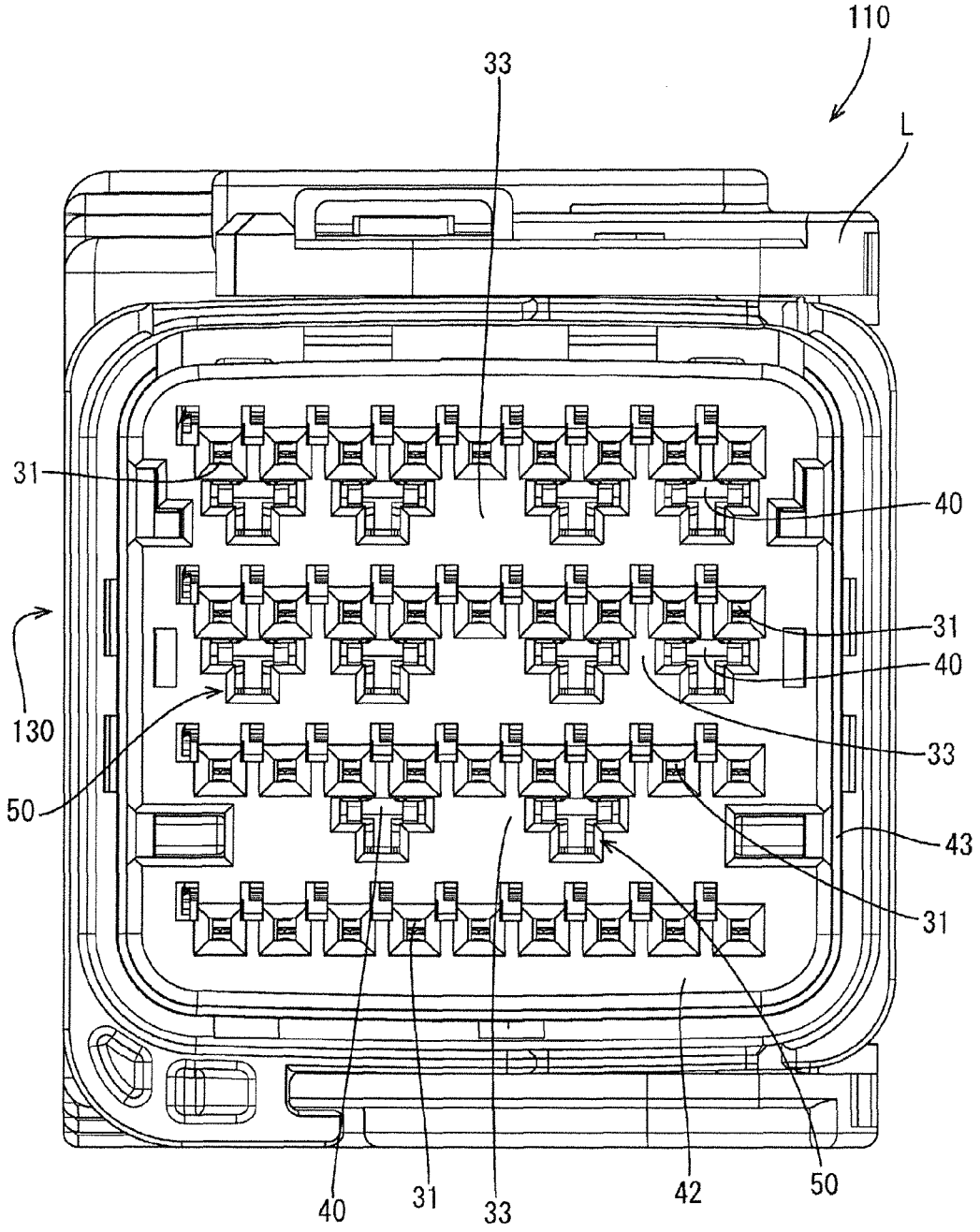
FIG. 13 is a front view of a waterproof connector according to a second embodiment.
Figure 14:
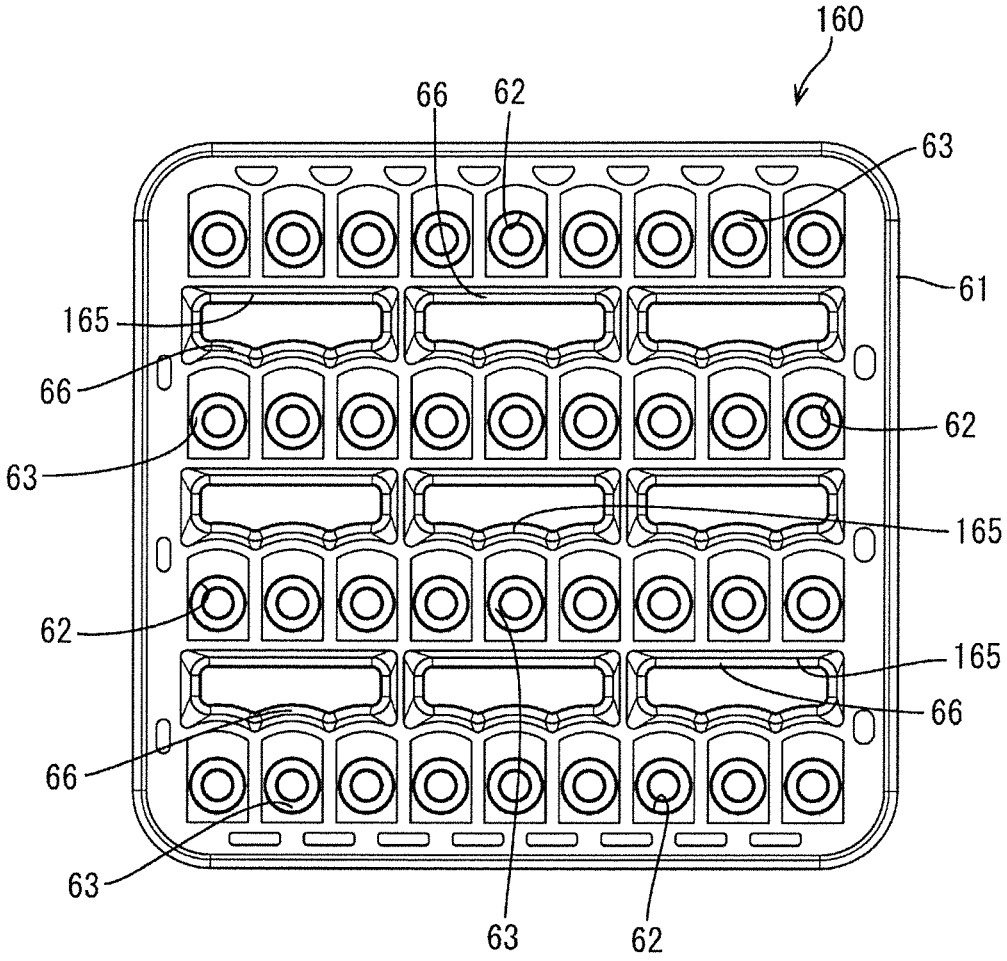
FIG. 14 is a rear view of a one-piece rubber plug.
Figure 15:
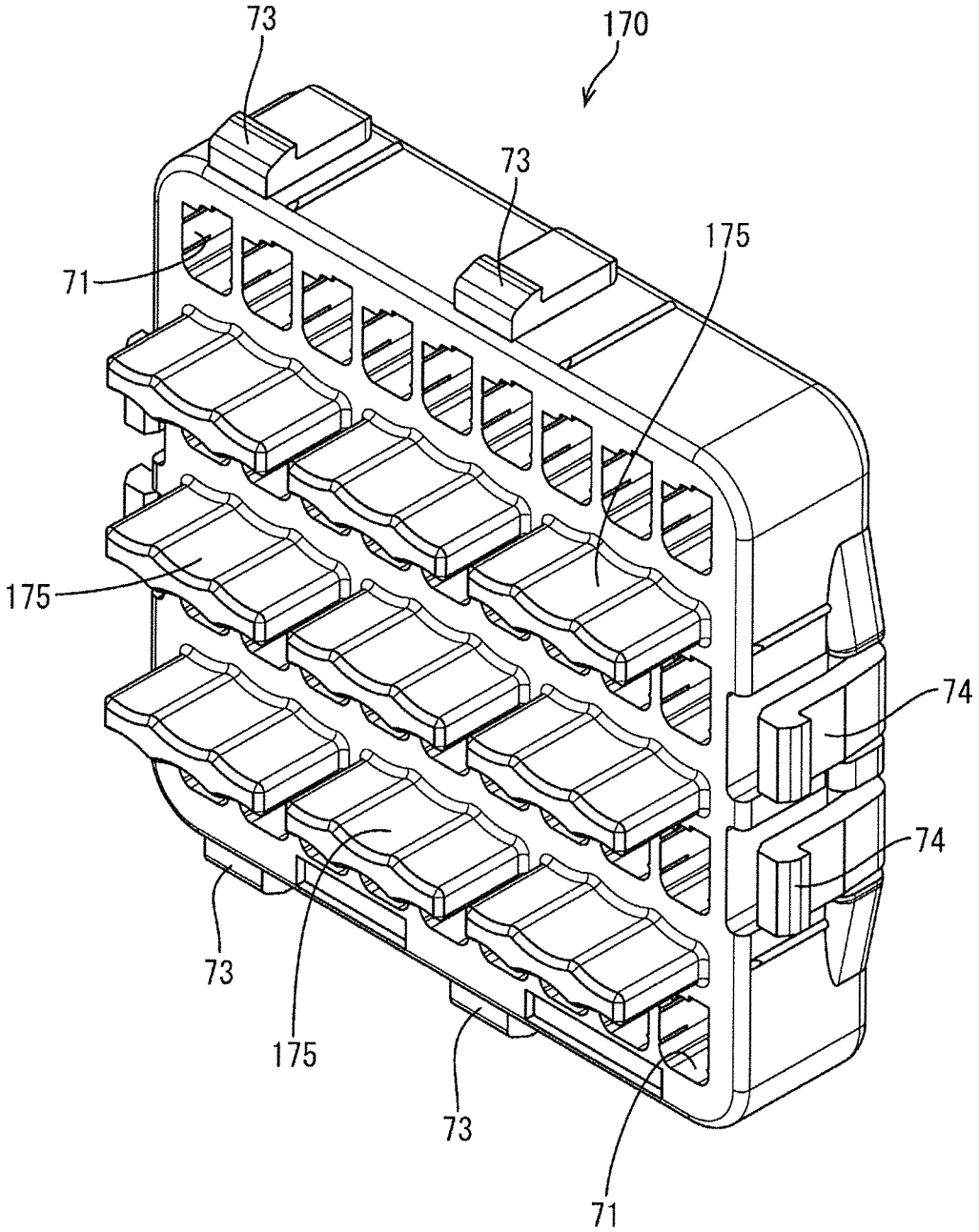
FIG. 15 is a perspective view of a rear holder.
Figure 16:
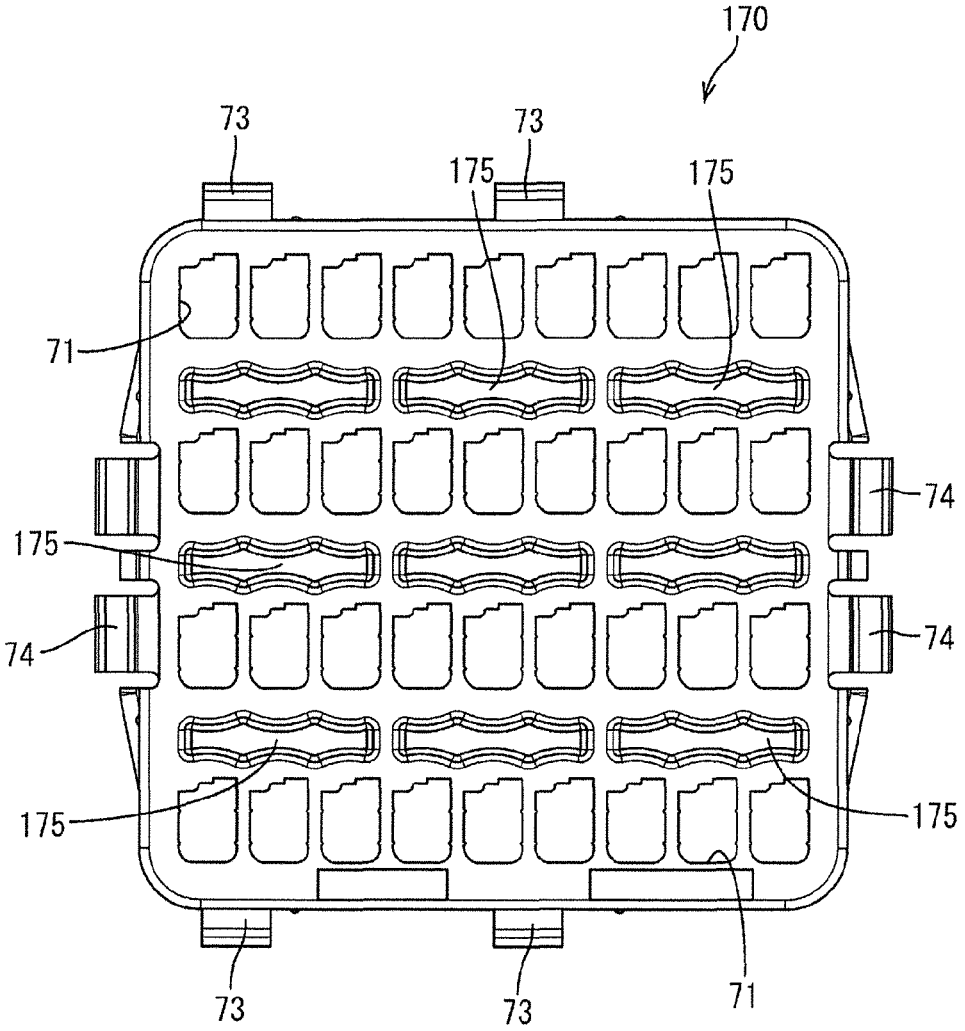
FIG. 16 is a front view of the rear holder.

The number of cavities 31 in a female housing 130 of the second embodiment is larger by 1 than that of the cavities 31 of the female housing 30 in the first embodiment in the width direction as shown in FIG. 13 and, associated with this, the number of through holes 62 of a one-piece rubber plug 160 and that of insertion holes 71 of a rear holder 170 are also larger by 1 in the width direction as shown in FIGS. 14 to 16.

Further, as shown in FIG. 14, a recess 165 of the one-piece rubber plug 160 has a substantially rectangular shape long in the width direction and having a width corresponding to three through holes 62. As shown in FIGS. 15 and 16, a compressing protrusion 175 of the rear holder 170 has a substantially rectangular shape long in the width direction and having a width corresponding to three insertion holes 71, similar to the recess 165. Further, the upper surface of the compressing protrusion 175 is recessed arcuately to correspond to the insertion holes 71, similar to the lower surface. As a result the compressing protrusion 175 is vertically symmetrical.

That is, according to this embodiment, three recesses 165 are arranged side by side in the width direction on the one-piece rubber plug 160 and three compressing protrusions 175 are arranged side by side in the width direction on the rear holder 170. The structures of the one-piece rubber plug 160 and the rear holder 170 can be simplified drastically, for example, as compared to the case where one recess and one compressing protrusion are formed for one through hole, and the production cost of the waterproof connector 110 can be reduced.

Further, since the compressing protrusion 175 is recessed arcuately to correspond to the insertion holes 71, inner peripheral lips 63 can be pressed to follow the outer peripheral surfaces of the wires W when the compressing protrusion 175 is press-fitted into the recess 165.

The present invention is not limited to the above described and illustrated embodiments. For example, the following embodiments are also included in the technical scope of the present invention.

In the above embodiments, the terminal accommodating portions 40 for accommodating the shorting terminals 50 are formed below the cavities 31 to communicate with the cavities 31. However, there is no limitation to this and terminal accommodating portions may be formed above cavities to communicate with the cavities.

In the above embodiments, the recesses 65, 165 having a width corresponding to two or three through holes 62 and the compressing protrusions 75, 175 having a width corresponding to two or three insertion holes 71 are formed. However, there is no limitation to this and recesses having a width corresponding to one through hole may be formed and compressing protrusions having a width corresponding to one insertion hole may be formed, or recesses having a width corresponding to four or more through holes may be formed and compressing protrusions having a width corresponding to four or more insertion holes may be formed.

In the above embodiments, the waterproof connector including the female housing 30 for accommodating the female terminals 20 is illustrated as an example. However, there is no limitation to this and the technique disclosed in this specification may be applied to a waterproof connector including a male housing for accommodating male terminals.

In the above embodiments, the waterproof connector 10 including the lever L is illustrated as an example. However, there is no limitation to this and the technique disclosed in this specification may be applied to a waterproof connector including no lever.

LIST OF REFERENCE SIGNS

10: waterproof connector
20: female terminal (terminal fitting)
30: female housing (housing)
31: cavity
40: terminal accommodating portion
50: shorting terminal
60: one-piece rubber plug (seal member)
62: through hole
65: recess
70: rear holder
75: compressing protrusion
W: wire

The invention claimed is:

1. A waterproof connector, comprising:

terminal fittings to be connected to ends of wires;

a housing formed with a plurality of cavities arranged side by side and configured such that the wires are accommodated therein from behind together with the terminal fittings;

terminal accommodating portions provided along an arrangement direction of the plurality of terminal fittings in a front end part of the housing and configured to accommodate shorting terminals for shorting the plurality of terminal fittings;

a seal to be fitted into the housing from behind, the seal having opposite front and rear faces and including a plurality of through holes extending through the seal from the front face to the rear face, the through holes being provided side by side to correspond to the cavities and configured such that the wires are inserted therethrough, the seal having a plurality of recesses extending into the rear face of the seal, each of the recesses having a closed front end, the recesses being provided along an arrangement direction of the through holes on the seal and being arranged behind laterally long terminal accommodating areas in the housing where the terminal accommodating portions are formed; and a rear holder held in the housing while being fit behind the seal in the housing and configured to retain the seal, a plurality of compressing protrusions projecting from the rear holder and inserted respectively into the recesses of the seal, the compressing protrusions being configured to press the seal in directions to reduce the through holes in diameter;

wherein:

a length of a part of the rear holder to be matched with and fitted into the housing in a connecting direction longer than a projecting distance of the press-fitting protrusions; and each of the recesses has a plurality of inner surfaces and a compressive lip is provided on the surface adjacent to the through hole.

2. The waterproof connector of claim 1, wherein each of the recesses is formed over a range of a plurality of the through holes.

3. The waterproof connector of claim 2, wherein:

the cavities are formed in a plurality of stages in a height direction perpendicular to the arrangement direction; and the recesses are formed between the through holes that are adjacent in the height direction.

4. The waterproof connector of claim 1 wherein the cavities are arranged in rows with the cavities in each of the rows being arranged side by side and with the respective rows being parallel, the through holes in the seal being provided side by side in rows at positions to correspond to the cavities and with the rows of through holes being parallel, the recesses of the seal being arranged in at least one row between adjacent rows of the through holes in the seal.

5. The waterproof connector of claim 4, wherein each of the compressing protrusions has a width in the arrangement direction sufficient to oppose at least two of the through holes in each adjacent row of the through holes.

* * * * *